US007470179B1

(12) United States Patent
Ritter et al.

(10) Patent No.: US 7,470,179 B1
(45) Date of Patent: Dec. 30, 2008

(54) SCREEN SYSTEM ALLOWING EASY DISASSEMBLY

(75) Inventors: Roy Ritter, Sturgis, MI (US); Robert J. Luter, II, Elkhart, IN (US)

(73) Assignee: Philips Products, Inc., Elkhart, IN (US)

( * ) Notice: Subject to any disclaimer, the term of this patent is extended or adjusted under 35 U.S.C. 154(b) by 692 days.

(21) Appl. No.: 10/769,932

(22) Filed: Feb. 2, 2004

Related U.S. Application Data

(60) Provisional application No. 60/444,021, filed on Jan. 31, 2003.

(51) Int. Cl.
*F24F 7/013* (2006.01)

(52) U.S. Cl. ..... 454/354; 454/349; 52/199

(58) Field of Classification Search ..... 52/198, 52/199, 200; 454/349, 199, 365, 366, 148, 454/367, 358, 35; 285/42
See application file for complete search history.

(56) References Cited

U.S. PATENT DOCUMENTS 1,623,659 A * 4/1927 Comerford ..... 454/367
2,828,682 A * 4/1958 Marker ..... 454/354
3,204,546 A * 9/1965 Krell ..... 454/272
4,175,480 A * 11/1979 Beam et al. ..... 454/278
4,184,414 A * 1/1980 Jarnot ..... 454/275
4,336,749 A * 6/1982 Barnhart et al. ..... 454/349
5,383,816 A * 1/1995 Marcello et al. ..... 454/359
5,791,985 A * 8/1998 Schiedegger et al. ..... 454/339
5,879,232 A * 3/1999 Luter et al. ..... 454/349
6,019,678 A * 2/2000 Takahashi ..... 454/354
6,327,427 B1 * 12/2001 Burkett ..... 392/369
6,766,545 B2 * 7/2004 Hodges ..... 4/679
6,893,339 B1 * 5/2005 Berger ..... 454/359
7,203,416 B2 * 4/2007 Craw et al. ..... 392/350

* cited by examiner

*Primary Examiner*—Richard E. Chilcot, Jr.
*Assistant Examiner*—Chi Q Nguyen
(74) *Attorney, Agent, or Firm*—Calfee, Halter & Griswold LLP

(57) ABSTRACT

A screen system which can be easily disassembled and includes a screen, a frame supporting the screen where the frame includes a hook, and a housing supporting the frame. The housing defines a retainer which interacts with the hook whereby upon rotation of the frame in a first direction the hook engages the retainer and upon rotation of the frame in a second direction the hook disengages the retainer allowing disassembly of the screen system. The screen system may be part of a ventilation system.

13 Claims, 4 Drawing Sheets

SCREEN SYSTEM ALLOWING EASY DISASSEMBLY

RELATED APPLICATION

The application claims priority to U.S. Provisional Application Ser. No. 60/444,021 filed on Jan. 31, 2003, currently pending, and incorporates its entirety herein.

BACKGROUND OF THE INVENTION

Roof vents have been used for many years in a number of applications including use in recreational vehicles. Many roof vents include a fan and motor system in order to achieve the desired amount of draw in the stream of vented gas. For safety reasons a screen is included in the system so objects cannot be placed into the fan blades. The screen requires periodic removal, typically during maintenance of the roof vent. Screens have been typically heat staked to a housing of the roof vent. For the screen to be removed without being damaged, the entire housing must be unscrewed and disassembled. This is a difficult and time consuming process. As an improvement over this type of system, a more modern system was devised in which the screen is simply heat staked to a frame and the frame attached to a housing on the roof vent. However, the frame is still attached to the housing a large number of screws. The removal of these screws takes a significant amount of time and often screws are lost during maintenance of the roof vent.

An improved manner of attaching a screen and frame to a housing on a roof vent is desired. This new system should allow for quick disassembly without the use of tools and without parts which may be lost.

SUMMARY OF THE INVENTION

The present system overcomes the drawback previously described. The present system may be easily disassembled without the use of tools and includes no parts which may be lost.

The present system provides a screen system which can be easily disassembled and includes a screen, a frame supporting the screen, where the frame includes hooks, and a housing supporting the frame. The housing defines retainers which interacts with the hooks whereby upon rotation of the frame in a first direction the hooks engage the retainers and upon rotation of the frame in a second direction the hooks disengage the retainers allowing disassembly of the screen system.

For a better understanding of the screen system of the present invention and its advantages, reference should be made to the following detailed description of the invention taken in conjunction with the accompanying drawings. Additionally, other features and advantages of the present invention will become apparent from the following detailed description of the preferred embodiments made with reference to the accompanying drawings, which are incorporated in and form a part of the specification.

DETAILED DESCRIPTION OF THE PREFERRED AND ALTERNATE EMBODIMENTS

Figure 1:
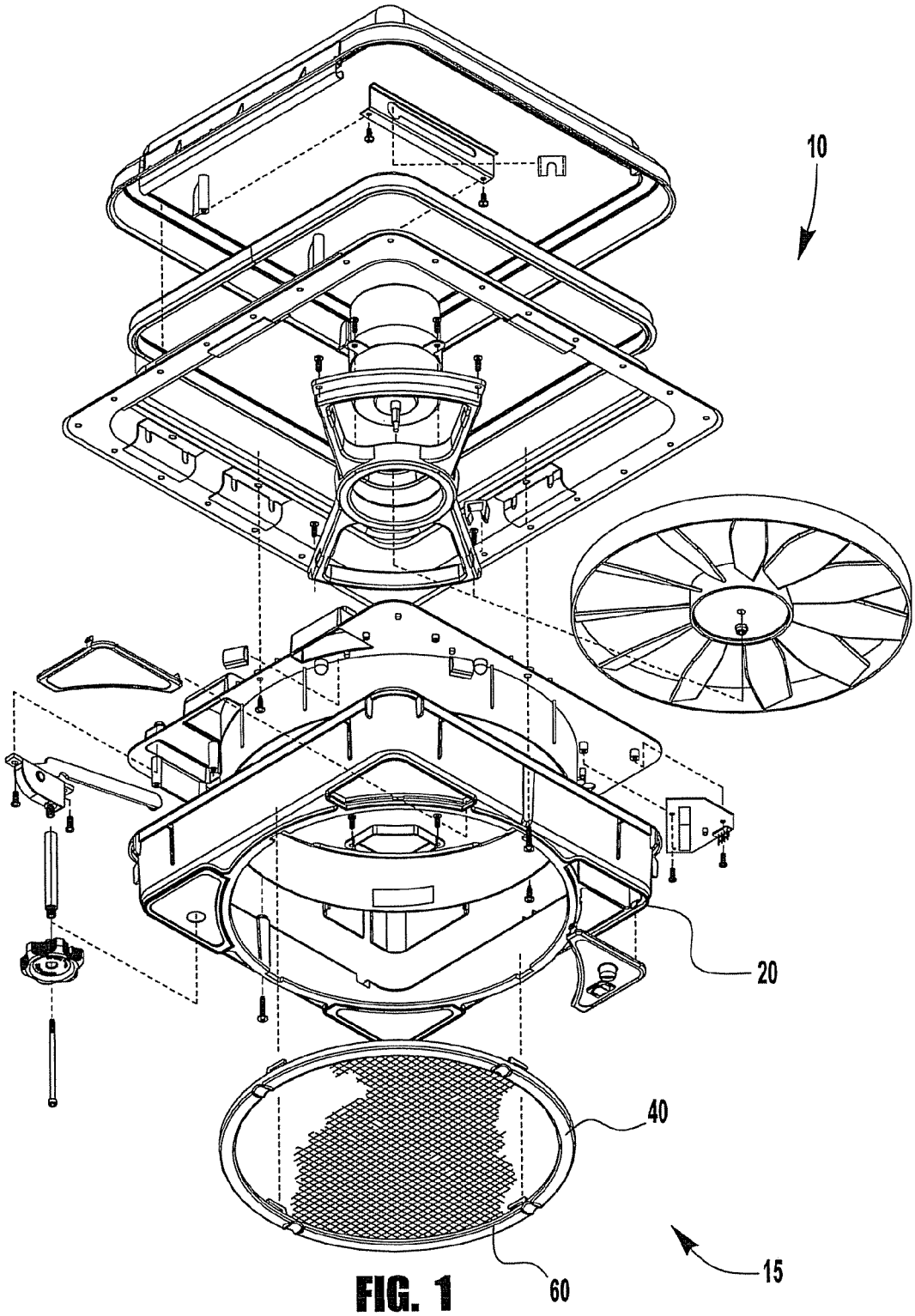
FIG. 1 is an exploded view of a vent system including the screen system of the present invention.

Referring to FIG. 1, an exploded view of a vent system 10 including the screen system 15 of the present invention is shown. As described in more detail below the screen system 15 comprises a housing 20, screen frame 40, and screen 60. The invention provides the advantage of being easily disassembled without the use of tools. The screen 60 and screen frame 40 may be easily rotated in one direction into a locked position and in an opposite direction into an unlocked position. In the unlocked position, the screen 60 and screen frame 40 may be easily disassembled from the housing 20 and the remainder of the vent system 10. The screen system 15 may be part of a vent system 10 used in a structure like a home, or in a recreational vehicle.

Figure 2A:
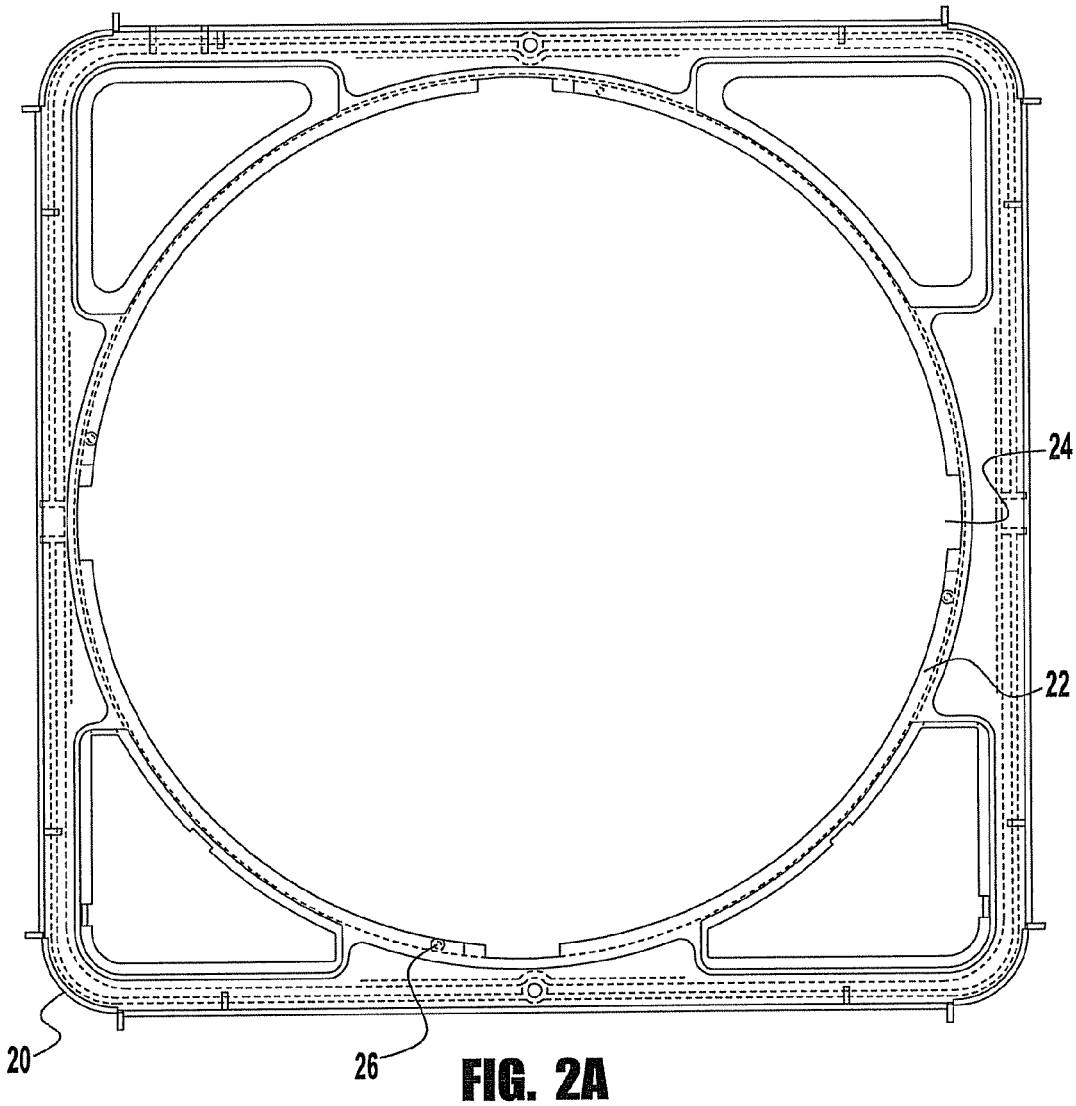
FIG. 2A is a top view of a housing of the screen system of the present invention.
Figure 2B:
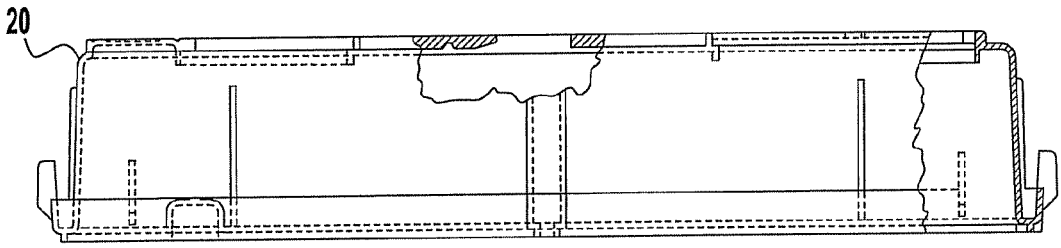
FIG. 2B is a side view of the housing of the screen system of the present invention.

FIGS. 2A and 2B show the housing 20 in the absence of the screen 60 and screen frame 40. The housing 20 preferably has a rectangular exterior shape, but may be any shape dictated by the needs of the remainder of the vent system 10. The housing 20 preferably has a circular interior shape. The interior of the housing 20 defines an aperture. The aperture functions as the passage for venting gasses, typically air, through the vent system 10. The housing 20 functions to support the screen 60 and screen frame 40 within the vent system 10. The housing 20 may be made from any material, but preferably is a polymer or steel. The housing 20 may be made by a molding process. Any part of the vent system 10 which provides a seat for the screen frame 40 may be substituted for the housing 20. In a preferred embodiment of the invention, the housing 20 is attached to the remainder of the vent system 10 using mechanical fasteners. The housing 20 may also be integrally formed with other parts of the venting system 10. As described in more detail below the housing 20 supports the screen frame 40 on a seat 22. The housing 20 is typically oriented at the lowermost section of the vent system 10.

The housing 20 defines a seat 22 for supporting the screen frame 40 and the screen 60 which is attached to the screen frame 40. The seat 22 protrudes inwardly from the remainder of the housing 20 into the aperture defined by the housing 20. The seat 22 preferably is a circular protrusion which includes one or more gaps 24 along its circumference. Each gap 24 may have a radial width (distance from outer diameter to inner diameter) equal to the radial width of the seat 22 or may be smaller than the radial width of the seat 22. The seat 22 is preferably made from the same material as the rest of the housing. As a substitute, a seat 22 formed separately from the housing 20 may be attached to the housing 20. The seat 22 supports the screen frame 40 and interlocks with a hook 42 upon the screen frame 40 as described in more detail below. The thickness of the seat 22 is typically smaller than the thickness of surrounding housing 20, but may be any size. The seat 22 protrudes inwardly in a planar manner which allows the screen frame 40 to be rotated upon the seat 22 in a level manner.

Figure 4A:
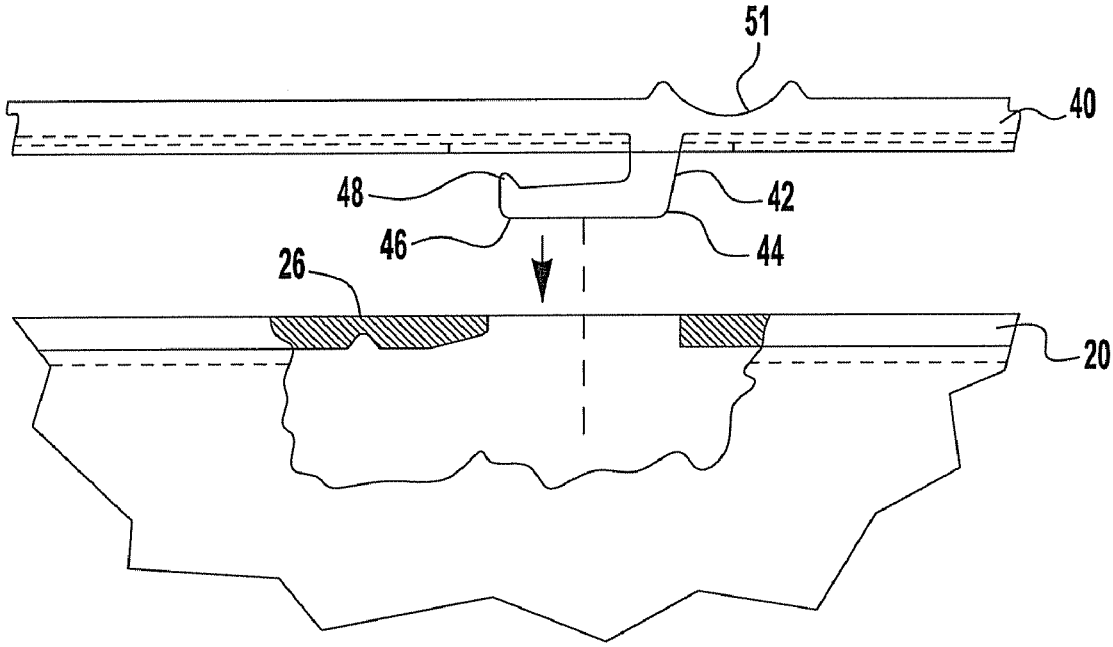
FIG. 4A is a cutaway view of a section of the screen frame and housing in a disassembled state.
Figure 4B:
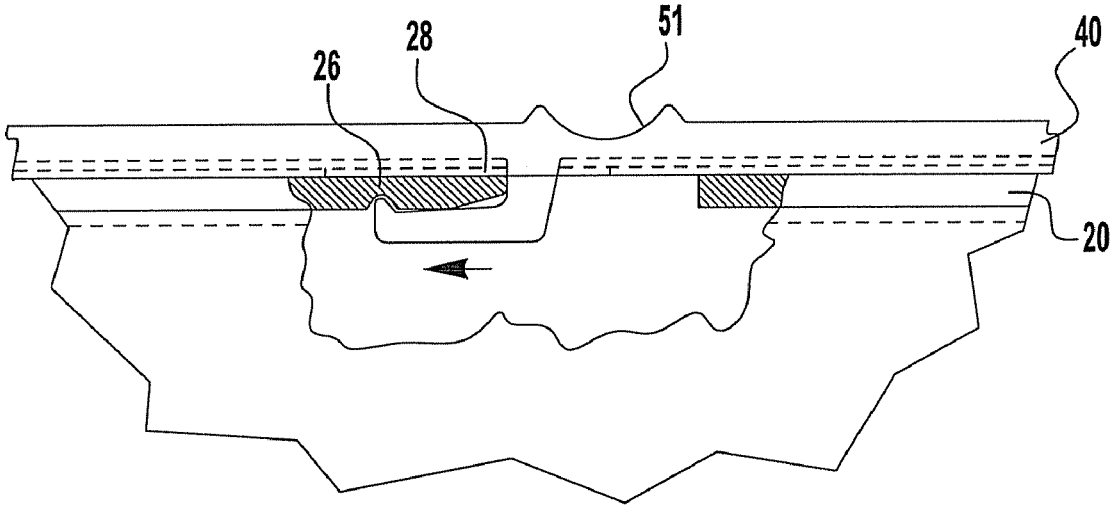
FIG. 4B is a cutaway view of a section of the housing and a section of the screen frame in a locked state.

The seat 22 of the housing defines one or more retainers 26. The retainers 26 as shown in FIGS. 4*a* and 4*b* preferably are a simple depression within the surface of the seat 22. The depression is preferably on a side of the seat opposite which the screen frame 40 abuts when in a locked position. The hook 42 on the screen frame 40, thus, protrudes through a gap 24 in the seat 22 and finds the retainer 26 when the screen frame 40 is rotated. As a substitute for a depression the retainer 26 may define a slot which extends partially through the seat or an aperture which extends all the way through the seat 22. The retainer 26 functions to hold the hook 42 of the screen frame 40 in place when the screen frame 40 is in a locked position. The retainer 26 receives the finger 48 of the hook 42. Any number of retainers 26 may be used on the seat 22 of the housing 20. Preferably, the number of retainers 26 equals the number of hooks 42 on the screen frame 40. However the number of retainers 26 and gaps 24 may also exceed the number of hooks 42 which may allow a screen frame 40 to be locked in a varying number of orientations. The retainers 26 are configured adjacent to the gaps 24 defined by the housing seat 22. As a result, only a small degree of rotation is necessary after the screen frame 40 is placed into a first seated position by passing the hooks 42 through the gaps 24 in the housing seat 22. Other retainers offering the same functional performance would include wedges or other protrusions offering a radial interface with mating retainers such that minimal rotation of the screen frame would result in secure and aligned retention of the screen frame to the housing.

Figure 3A:
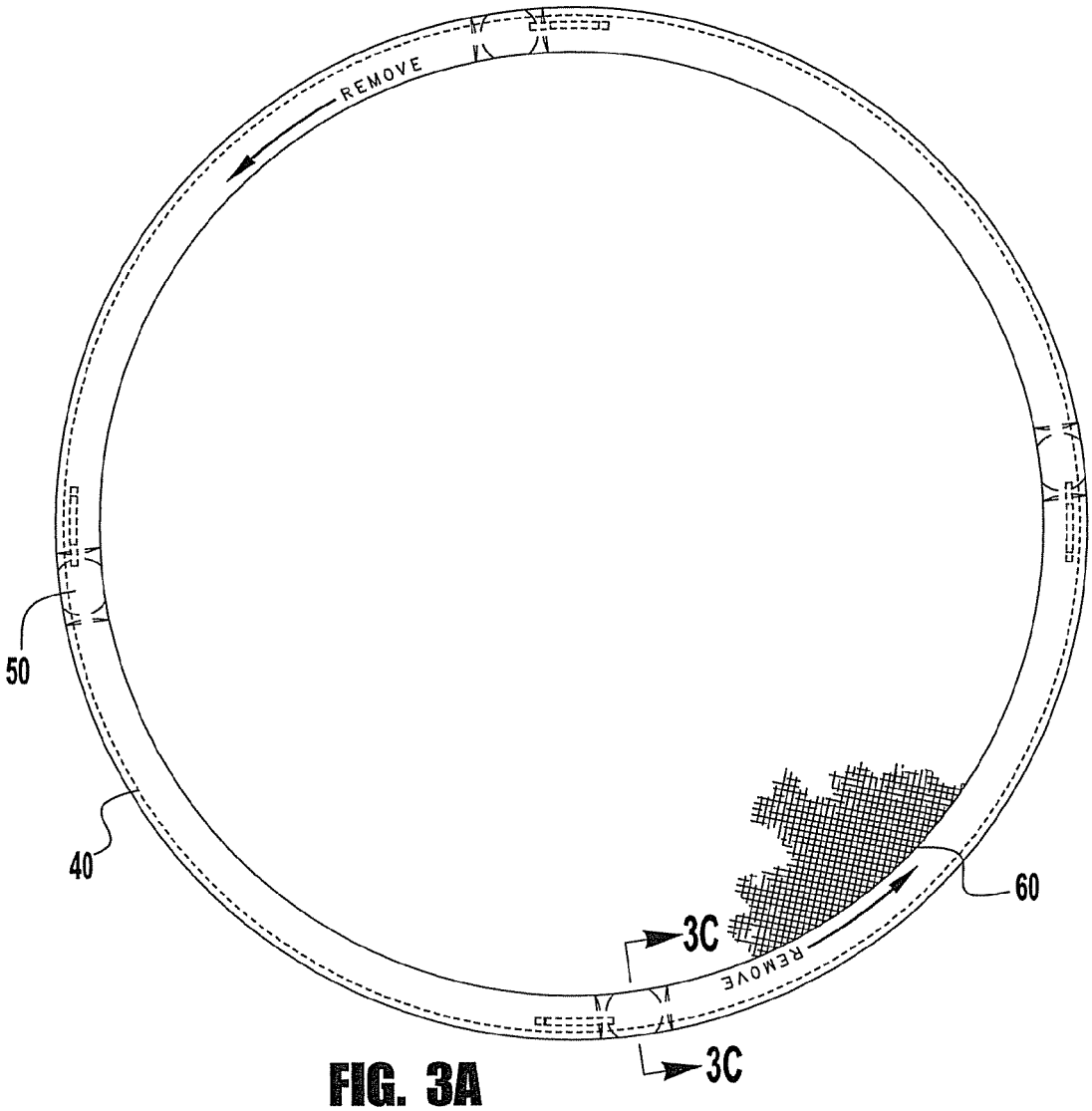
FIG. 3A is a top view of a screen and screen frame of the present invention.
Figure 3B:
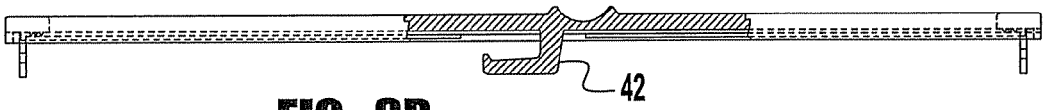
FIG. 3B is a side view of the screen and screen frame of the present invention.

FIGS. 3A and 3B show the screen frame 40 which supports a screen 60 and which is supported by the housing 20. Preferably the screen frame 40 is circular in shape. The screen frame 40 may be shaped similarly to the seat 22 upon the housing 20. The width, distance between outer and inner diameters, of the screen frame 40 may be large enough to provide strength, but minimized in order minimize restriction of the gas passage through the housing 20. The screen frame 40 may be made from any type of material, but preferably is made from a polymer. In an alternate embodiment, hooks are simply embedded in a relatively rigid screen, thus, negating the need for a screen frame. The screen frame 40 functions to support a screen 60 and provide attachment elements to the housing 20.

Referring to FIGS. 4A and 4B the screen frame includes a hook 42 which engages the retainer 26 of the housing 20. The hook 42 preferably includes a first arm 44, second arm 46 and finger 48. The first arm 44 may protrude generally perpendicularly from a face of the screen frame 40. The second arm 46 may protrude generally perpendicularly from the first arm 44. The finger 48 may protrude generally perpendicularly from the second arm 46 and in a direction towards the screen frame 40. The hook 42 may be formed integrally with the screen frame 40 or attached as a separate piece. As described above the hook 42 functions to hold the screen frame 40 and screen 60 in a locked position. In alternate embodiments, the hook may be any shape which defines a finger which may engage the retainer. The hook 42 has an overall width, from a first end the second arm to the opposite end of the second arm, which is smaller than the circumferential width of the gap 24 defined by the housing 20. This allows the hook 42 to be pushed through the gap 24 defined by the housing 20. After this insertion the hook 42 may be moved to a locked position by rotation of the screen frame 40. To aide in rotation, the edge 28 of the seat 22 on the housing 20 may be chamfered, thus, allowing the finger 48 of the hook 42 to ride easily onto the seat 22. The hook 42 may be resilient. The hook 42 may snap into a final position as it reaches the retainer 26 in the housing 20 and enters the retainer 26. In a preferred embodiment of the invention, the screen frame 40 comprises four hooks 42. The finger 48 of the hook 42 may also be chamfered on one surface to allow for easy displacement from within the retainer.

The screen frame 40 may also define at least one engagement surface 50. The engagement surface 50 may be on a face of the screen frame 40 opposite that of the hook 42. In a preferred embodiment, the engagement surface 50, although on an opposite side, is adjacent to the hook. The engagement surface 50 functions to allow the screen frame 40 to be rotated without the use of a tool. A user places their finger or thumb against one or more engagement surfaces 50 and pushes or pulls as required to lock or unlock the screen frame 40. Preferably the engagement surface 50 is a depression 51 in the face of the screen frame 40. A knob or handle may be substituted for the engagement surface 50. The engagement surface may also be a set of raised ridges or a form of surface texturing. In a preferred embodiment of the invention, the screen frame 40 comprises four engagement surfaces 50.

Figure 3C:
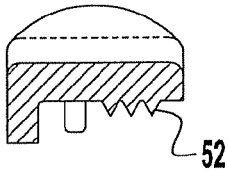
FIG. 3C is a sectional view of a portion of the screen frame.

FIG. 3*a* shows the screen 60 supported by the screen frame 40. The screen 60 may be of any type known in the art and may be formed from metal or polymer. The screen 60 may be heat staked to the screen frame. FIG. 3*c* shows three protruding ridges 52 which may be partially melted during assembly to bind the screen 60 to the screen frame 40. Alternately, the screen 60 may be attached to the screen frame 40 using adhesive, screws or other mechanical elements. The housing 20 and/or screen frame 40 may additionally include instructions molded into their surfaces. These instructions may direct a user how to assembly or disassembly the screen system. Alternately the wording may be placed on an adhesive label and attached.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents. Use of the term "or" herein is the inclusive, and not the exclusive use.

The invention claimed is:

1. A screen system which can be easily disassembled comprising:

a screen;

a frame supporting said screen, said frame including a hook; and a housing for supporting said frame when said screen system is assembled, said housing defining a retainer which interacts with said hook whereby upon rotation of said frame in a first direction said hook engages said retainer and upon rotation of said frame in a second direction said hook disengages said retainer allowing disassembly of said screen system, wherein said hook comprises a first arm section generally perpendicular to said frame, a second arm section integral with said first arm section and generally parallel to said frame and a finger extending from said second arm section for engaging said retainer on said housing.

2. The screen system of claim 1 wherein said hook is integrally formed with said frame.

3. The screen system of claim 1 wherein said retainer comprises a depression within said housing.

4. The screen system of claim 1 wherein said housing defines a seat which supports said frame when said screen system is assembled, said seat defining an aperture for the passage of said hook whereby during assembly of said screen system said hook passes through said aperture prior to rotation into engagement.

5. The screen system of claim 4 wherein said seat is integrally formed with said housing.

6. The screen system of claim 1 wherein said frame includes four hooks and said housing includes at least four retainers.

7. The screen system of claim 1 wherein said frame further comprises an engagement surface for a digit of a user, allowing the frame to be easily rotated.

8. The screen system of claim 1 wherein said housing defines a seat which supports said frame when said screen system is assembled, said seat defining a gap for the passage of said hook whereby during assembly of said screen system said hook passes through said gap prior to rotation into engagement.

9. The screen system of claim 8 wherein said frame further comprises an engagement surface for a digit of a user, allowing the frame to be easily rotated.

10. The screen system 8 wherein the gap has a radial width about equal to the radial width of the seat.

11. A screen system which can be easily disassembled comprising:

a screen;

a frame supporting said screen, said frame including a hook; and a housing for supporting said frame when said screen system is assembled, said housing defining a retainer which interacts with said hook whereby upon rotation of said frame in a first direction said hook engages said retainer and upon rotation of said frame in a second direction said hook disengages said retainer allowing disassembly of said screen system, wherein said frame further comprises an engagement surface for a digit of a user, allowing the frame to be easily rotated, and wherein said engagement surface comprises a depression located on a side of said frame opposite said hook.

12. The screen system of claim 11 wherein said engagement surface is adjacent to said hook.

13. The screen system of claim 11 wherein said retainer comprises a depression formed in the housing and said hook comprises a first arm section generally perpendicular to said frame, a second arm section integral with said first arm section and generally parallel to said frame and a finger extending from said second arm section, wherein said finger is received by said depression to hold said frame in position relative to said housing.

* * * * *